US007436374B2

(12) United States Patent
Chi

(10) Patent No.: US 7,436,374 B2
(45) Date of Patent: Oct. 14, 2008

(54) PLASMA DISPLAY PANEL AND DRIVING METHOD THEREOF

(75) Inventor: Yong-Seok Chi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 613 days.

(21) Appl. No.: 10/959,846

(22) Filed: Oct. 7, 2004

(65) Prior Publication Data

US 2005/0078063 A1 Apr. 14, 2005

(30) Foreign Application Priority Data

Oct. 9, 2003 (KR) ..... 10-2003-0070208
Nov. 10, 2003 (KR) ..... 10-2003-0079109

(51) Int. Cl.
*G09G 3/28* (2006.01)

(52) U.S. Cl. ..... 345/60; 345/63; 345/66; 345/68; 345/69

(58) Field of Classification Search ..... 345/60–69, 345/98, 204, 76, 211, 70, 157, 3.1; 315/169.3; 323/282; 313/582; 363/15; 324/543; 84/615; 355/55; 726/7; 713/310; 700/266
See application file for complete search history.

(56) References Cited

U.S. PATENT DOCUMENTS 4,839,699 A * 6/1989 Hosaka et al. ..... 355/55
4,943,929 A * 7/1990 Simonoff ..... 700/266
5,541,618 A 7/1996 Shinoda
5,548,764 A * 8/1996 Duley et al. ..... 713/310
5,563,493 A * 10/1996 Matsuda et al. ..... 320/124
5,629,715 A * 5/1997 Zenda ..... 345/3.1
5,661,349 A * 8/1997 Luck ..... 307/151
5,661,500 A 8/1997 Shinoda et al.
5,663,741 A 9/1997 Kanazawa (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Prabodh Dharia
(74) *Attorney, Agent, or Firm*—Robert E. Bushnell, Esq.

(57) ABSTRACT

In a Plasma Display Panel (PDP) power control apparatus, an internal voltage of a power supply is detected, and a determination is made as to whether an Alternating Current (AC) power input to the power supply has been turned off on the basis of the detected internal voltage. The output of the power supply is controlled according to a predetermined sequence based on a result of the determination to turn off the PDP. The apparatus rapidly and accurately senses that the AC power has been turned off and performs a predetermined power off sequence to prevent damage to a driving circuit and to prevent the picture quality of the PDP from being degraded.

13 Claims, 4 Drawing Sheets

U.S. PATENT DOCUMENTS

| | | | | |
|---|---|---|---|---|
| 5,674,553 | A | 10/1997 | Shinoda et al. | |
| 5,724,054 | A | 3/1998 | Shinoda | |
| 5,767,659 | A * | 6/1998 | Farley | 320/106 |
| 5,786,794 | A | 7/1998 | Kishi et al. | |
| 5,870,621 | A * | 2/1999 | Walsh et al. | 712/32 |
| 5,945,972 | A * | 8/1999 | Okumura et al. | 345/98 |
| 5,952,782 | A | 9/1999 | Nanto | |
| 5,962,975 | A * | 10/1999 | Lepselter | 313/586 |
| 6,121,945 | A * | 9/2000 | Tanaka et al. | 345/94 |
| RE37,444 | E | 11/2001 | Kanazawa | |
| 6,323,851 | B1 * | 11/2001 | Nakanishi | 345/211 |
| 6,330,676 | B1 * | 12/2001 | Kelsey | 726/7 |
| 6,400,344 | B1 * | 6/2002 | Tsunoda et al. | 345/60 |
| 6,522,314 | B1 * | 2/2003 | Tomio et al. | 345/68 |
| 6,628,087 | B2 * | 9/2003 | Roh et al. | 315/169.3 |
| 6,630,916 | B1 | 10/2003 | Shinoda | |
| 6,707,436 | B2 | 3/2004 | Setoguchi et al. | |
| 6,927,751 | B2 * | 8/2005 | Ide et al. | 345/67 |
| 7,064,732 | B2 * | 6/2006 | Van Der Broeck et al. | 345/60 |
| 7,088,354 | B2 * | 8/2006 | Matsumoto | 345/207 |
| 2001/0015123 | A1 * | 8/2001 | Nishitani et al. | 84/615 |
| 2002/0044145 | A1 * | 4/2002 | Tomio et al. | 345/211 |
| 2002/0047552 | A1 * | 4/2002 | Sano et al. | 315/169.2 |
| 2002/0070709 | A1 * | 6/2002 | Small et al. | 320/150 |
| 2002/0180668 | A1 * | 12/2002 | Ide et al. | 345/60 |
| 2003/0169052 | A1 * | 9/2003 | Yamada et al. | 324/543 |
| 2003/0184501 | A1 * | 10/2003 | Lee | 345/60 |
| 2004/0017355 | A1 * | 1/2004 | Shim | 345/157 |
| 2004/0062058 | A1 * | 4/2004 | Hann et al. | 363/15 |
| 2005/0029956 | A1 * | 2/2005 | Van Der Broeck et al. | 315/160 |
| 2005/0134533 | A1 * | 6/2005 | Sasada et al. | 345/60 |
| 2006/0077169 | A1 * | 4/2006 | Fujikawa | 345/102 |
| 2006/0176248 | A1 * | 8/2006 | Tomio et al. | 345/60 |

FOREIGN PATENT DOCUMENTS

| | | | |
|---|---|---|---|
| JP | 09-212124 | | 8/1997 |
| JP | 10-268834 | | 10/1998 |
| JP | 2845183 | | 10/1998 |
| JP | 2917279 | | 4/1999 |
| JP | 2000-148082 | | 5/2000 |
| JP | 2001-043804 | | 2/2001 |
| JP | 2001-268911 | | 9/2001 |
| JP | 2001-325888 | | 11/2001 |
| JP | 2002-132210 | | 5/2002 |
| JP | 2003-263126 | | 9/2003 |
| KR | 2001-0111906 | | 12/2001 |
| KR | 2002030611 | A * | 4/2002 |
| KR | 2002057563 | A * | 7/2002 |
| KR | 2003-0031658 | | 4/2003 |
| KR | 2004-0026361 | | 3/2004 |

* cited by examiner

PLASMA DISPLAY PANEL AND DRIVING METHOD THEREOF

CLAIM OF PRIORITY

This application makes reference to, incorporates the same herein, and claims all benefits accruing under 35 U.S.C. § 119 from applications for PLASMA DISPLAY PANEL AND METHOD FOR DRIVING THE SAME earlier filed in the Korean Intellectual Property Office on 9 Oct. 2003 and 10 Nov. 2003 and there duly assigned Serial Nos. 2003-70208 and 2003-79109, respectively.

BACKGROUND OF THE INVENTION

1. Field of the Invention

The present invention relates to a Plasma Display Panel (PDP) and a driving method thereof.

2. Description of the Related Art

Recently, flat panel displays, such as Liquid Crystal Displays (LCDs), Field Emission Displays (FEDs) and PDPs, have been actively developed.

The PDPs are superior to the other flat panel displays with regard to their high luminance, high luminous efficiency and wide viewing angle. Accordingly, the PDPs are being used as a substitute for conventional Cathode Ray Tubes (CRTs) for large-screen displays of more than 40 inches.

The PDPs are flat panel displays that use a plasma generated by a gas discharge to display characters or images. The PDPs include, according to their size, more than several tens to millions of pixels arranged in the form of a matrix. These PDPs are classified as Direct Current (DC) PDPs and Alternating Current (AC) PDPs according to the driving voltages supplied thereto and the discharge cell structures thereof.

The DC PDP has electrodes exposed to a discharge space, thereby causing a current to directly flow through the discharge space during the application of a voltage to the DC PDP. In this connection, the DC PDP has a disadvantage in that it requires a resistor for limiting the current. On the other hand, the AC PDP has electrodes covered with a dielectric layer that 1l naturally forms a capacitance component to limit the current and to protect the electrodes from the impact of ions during a discharge. As a result, the AC PDP is superior to the DC PDP in regard to an operating lifetime.

A conventional power supply for such a PDP includes, at its input stage, a Power Factor Correction (PFC) circuit that receives input power from an AC power source and corrects a power factor of the input power to meet a power factor condition. As a result, the power supply supplies stable power to the PDP with the PFC circuit.

That is, upon receiving a rated AC input voltage, the PDP power supply supplies a basic voltage to each element of the PDP. A video signal processor outputs a PFC enable signal, or a signal for turning on a relay in the PDP power supply, which is then input to the power supply.

In response to the PFC enable signal, the PDP power supply sequentially outputs a voltage for video signal processing, a driver switch driving voltage and a PDP driving voltage so that the PDP can operate normally.

The conventional PDP power supply includes the AC power on sequence for driving the PDP, as mentioned above, but does not include an AC power off detector or a sequence for performing a PDP power off operation when the AC power is turned off, and rather senses the AC power off state by merely detecting a standby voltage.

As a result, a driving circuit may be damaged due to an incomplete operation sequence of the power supply during a transient period, such as when the PDP is turned on and off, when the PFC is enabled after the relay in the power supply is turned on, when the PFC is disabled after the relay in the power supply is turned off, or when the relay in the power supply is repeatedly turned on and off.

In detail, during a transient period of the operation of the PDP set, a driving circuit that outputs a driving waveform may be damaged and the picture quality of the PDP may be degraded, due to a timing mismatch between a video signal processing circuit that outputs a video signal and the driving circuit and an imbalance of charge and discharge times during repeated charge and discharge periods of a storage capacitor in the driving circuit, thereby degrading the reliability of the product.

SUMMARY OF THE INVENTION

Therefore, it is an object of the present invention to provide a PDP power control apparatus and method which senses that the AC power to a power supply for a PDP has been turned off and performs a predetermined power off sequence, thereby preventing a driving circuit from being damaged and preventing the picture quality of the PDP from being degraded.

In accordance with one aspect of the present invention, a plasma display panel is provided comprising: a power supply adapted to supply power to the plasma display panel; a driving circuit adapted to drive the plasma display panel with voltages and currents supplied from said power supply; a logic unit adapted to output a control signal to control said driving circuit; and a plasma panel adapted to display video data from said logic unit, said plasma panel including a plurality of address electrodes and a plurality of first electrodes and a plurality of second electrodes arranged to intersect said address electrodes; wherein said power supply includes a power off detector adapted to detect an internal voltage of said power supply and to determine if Alternating Current (AC) power input to said power supply has been turned off on the basis of the detected internal voltage; and wherein said logic unit is adapted to output a control signal to turn off the plasma display panel in response to an output signal from said power off detector.

The power off detector can comprise: a discharge voltage detector adapted to detect a voltage for a sustain discharge of the plasma display panel from among the voltages supplied from said power supply and to output a signal corresponding to the detected voltage; and a power off determiner adapted to determine if said AC power input to said power supply has been turned off on the basis of the output signal from said discharge voltage detector and to output a result of the determination to said logic unit.

The power off detector can also comprise: a photocoupler adapted to detect a voltage of said AC power input to said power supply; and an Analog to Digital Converter (ADC) adapted to convert an output signal of said photocoupler into a digital signal.

The power off detector can be adapted to output a high-level signal to said logic unit when said AC power is turned on, and to output a low-level signal to said logic unit when said AC power is turned off.

The logic unit can be adapted to output a control signal to said driving circuit to control on/off operations of driving switches that drive said first and second electrodes in response to said output signal from said power off detector.

The driving switches can comprise a plurality of sustain discharge switches adapted to supply a sustain discharge voltage to said first and second electrodes; and said logic unit can be adapted to output a control signal to said driving circuit to turn on said sustain discharge switches for a predetermined period of time upon said output signal of said power off detector being at a low level.

The said logic unit can be adapted to output a control signal to said driving circuit to turn off said driving switches other than said sustain discharge switches for said predetermined period of time and to output a control signal to said driving circuit to turn off said sustain discharge switches and to turn on switches that supply a voltage of 0V to said first and second electrodes after said predetermined period of time has elapsed.

In accordance with another aspect of the present invention, a method of driving a plasma display panel is provided, the method comprising: supplying power to the plasma display panel with a power supply; driving the plasma display panel with voltages and currents supplied from said power supply via a driving circuit; outputting a control signal to control said driving circuit with a logic unit; displaying video data from said logic unit on a plasma panel, said plasma panel including a plurality of address electrodes, a plurality of first electrodes and a plurality of second electrodes arranged to intersect said address electrodes; detecting a voltage of said power supply; and outputting a control signal to said driving circuit on the basis of the detected voltage to control on/off operations of driving switches so as to perform a normal operation or a power off operation.

Detecting a voltage of said power supply can comprise detecting a sustain discharge voltage from among the voltages supplied by said power supply; and outputting a control signal to said driving circuit can comprise: comparing a value of the detected voltage with a pre-stored reference voltage value; determining if Alternating Current (AC) power input to said power supply has been turned off on the basis of a result of the comparison; and outputting said control signal on the basis of a result of the determination.

The method can further comprise setting said reference voltage value to a difference between a reduced voltage value of said logic unit and a value of said sustain discharge voltage during normal operation.

Detecting a voltage of said power supply can comprise: detecting a voltage of Alternating Current (AC) power input to said power supply; converting the detected voltage into a digital signal; and outputting the converted digital signal to said logic unit.

The voltage of said AC power can be detected via a photocoupler; and said digital signal can be set to a high level when said AC power is turned on, and is set to a low level when said AC power is turned off.

Outputting a control signal to said driving circuit can comprise: outputting a control signal for said normal operation until a next synchronous signal is input; outputting a control signal for a predetermined period of time to said driving circuit to turn off said driving switches other than sustain discharge switches that apply a sustain discharge voltage to said first and second electrodes, upon said next synchronous signal being input; and outputting a control signal to said driving circuit to turn off said sustain discharge switches and to turn on switches that supply a voltage of 0V to said first and second electrodes after said predetermined period of time has elapsed.

The method can further comprise: turning off power supply data output to said logic unit after outputting a control signal to said driving circuit; and turning off power supply data output to said driving circuit after an output of said logic unit is turned off.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
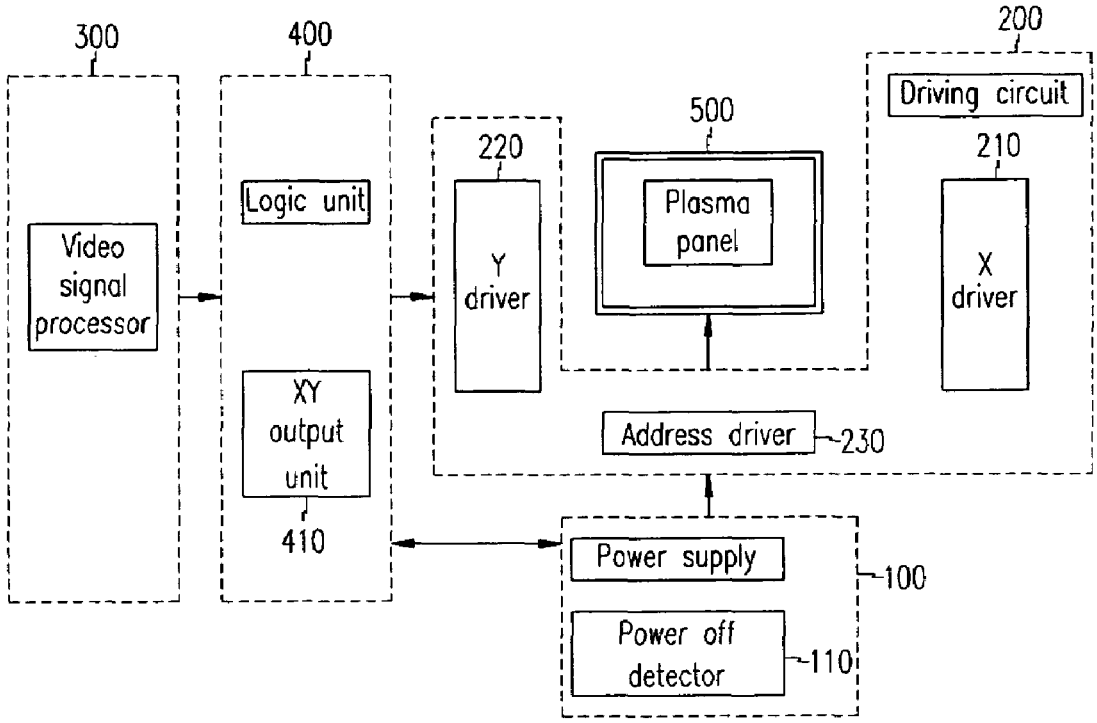
FIG. 1 is a detailed block diagram of the internal configuration of a PDP according to an embodiment of the present invention.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. In the drawings, illustrations of elements having no relation with the present invention have been omitted in order to prevent the subject matter of the present invention from being unclear. In the specification and drawings, the same or similar elements are denoted by the same reference numerals.

FIG. 1 is a detailed block diagram of the internal configuration of a PDP according to an embodiment of the present invention.

As shown in FIG. 1, the PDP according to the embodiment of the present invention comprises a power supply 100, a driving circuit 200, a video signal processor 300, a logic unit 400 and a plasma panel 500. The power supply 100 includes a power off detector 110 with a microprocessor or Analog to Digital Converter (ADC). The logic unit 400 includes an XY output unit 410. The driving circuit 400 includes a Y driver 220 for generating pulses to be supplied to scan electrodes (Y electrodes), an X driver 210 for generating pulses to be supplied to sustain electrodes (X electrodes), and an address driver 230 for generating pulses to be supplied to address electrodes.

In detail, the power supply 100 supplies desired voltages and currents to respective elements of the PDP, such as the driving circuit 200, the video signal processor 300, the logic unit 400 and the plasma panel 500. The driving circuit 200 drives the PDP using the voltages and currents supplied from the power supply 100.

The video signal processor 300 outputs video data and a control signal in response to an external input signal. The logic unit 400 outputs picture data including characters and images in response to the control signal from the video signal processor 300. The plasma panel 500 restores the picture data from the logic unit 400 to its original state.

The power off detector 110 of the PDP according to the embodiment of the present invention turns off the power to the PDP upon sensing an AC power off state. In the present embodiment, there are two ways to sense the AC power off state.

A power off detector 110*a* of the PDP according to a first embodiment of the present invention is adapted to detect a sustain discharge voltage which is output from the power supply 100 to the driving circuit 200, sense the AC power off state on the basis of the detected voltage and then turn off the power to the PDP.

When the AC power of the PDP is turned off, the sustain discharge voltage is first reduced abruptly and a discharge then occurs in the order of a logic voltage and standby voltage. The sustain discharge voltage is abruptly reduced due to a charge in a storage capacitor of the driving circuit being abruptly discharged because the logic unit 400 outputs data for a predetermined period of time until it is turned off even though the AC power has been turned off. Therefore, the power off detector 110*a* of the PDP according to the first embodiment of the present invention is adapted to determine if the AC power has been turned off from the sustain discharge voltage using such a phenomenon.

The operation of the power off detector 110*a* of the PDP according to the first embodiment of the present invention is described in detail below with reference to FIG. 2.

Figure 2:
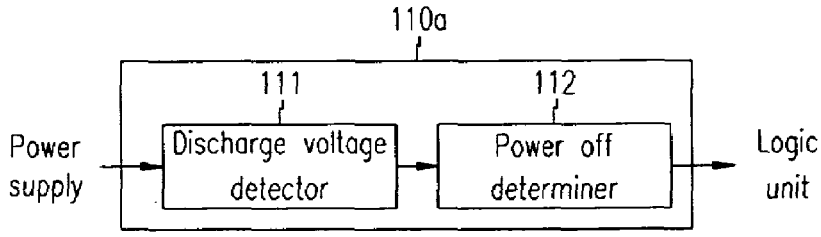
FIG. 2 is a block diagram of the internal configuration of a power off detector according to a first embodiment of the present invention.

FIG. 2 is a block diagram of the internal configuration of the power off detector 110*a* of the PDP according to the first embodiment of the present invention.

As shown in FIG. 2, the power off detector 110*a* of the PDP according to the first embodiment of the present invention includes a discharge voltage detector 111 and a power off determiner 112.

The discharge voltage detector 111 measures the sustain discharge voltage output from the power supply 100 and converts it into a digital value. The power off determiner 112 determines if the AC power has been turned off on the basis of the digital value of the sustain discharge voltage converted by the discharge voltage detector 111 and outputs a signal based on the determination.

In other words, the discharge voltage detector 111 periodically measures the sustain discharge voltage output from the power supply 100, converts it into a digital value and outputs the converted digital value to the power off determiner 112. Then, the power off determiner 112 compares the digital value from the discharge voltage detector 111 with a predetermined reference value and determines if the AC power has been turned off according to a result of the comparison. The reference value is equal to the reference sustain discharge voltage—$\alpha$, where $\alpha$ is a reduced voltage of the logic unit 400 and $0<\alpha<20$.

Upon determining that the AC power has been turned off, the power off determiner 112 outputs a power off sequence execution signal to the XY output unit 410.

On the other hand, a power off detector 110*b* of the PDP according to a second embodiment of the present invention is adapted to sense the AC power off state by detecting an AC input voltage Vin of the power supply 100 through a photocoupler, converting the resulting signal into a digital signal through an ADC or microprocessor and transferring the converted digital signal to the XY output unit 410 of the logic unit 400 to control driving waveforms of the X/Y electrodes.

Figure 3:
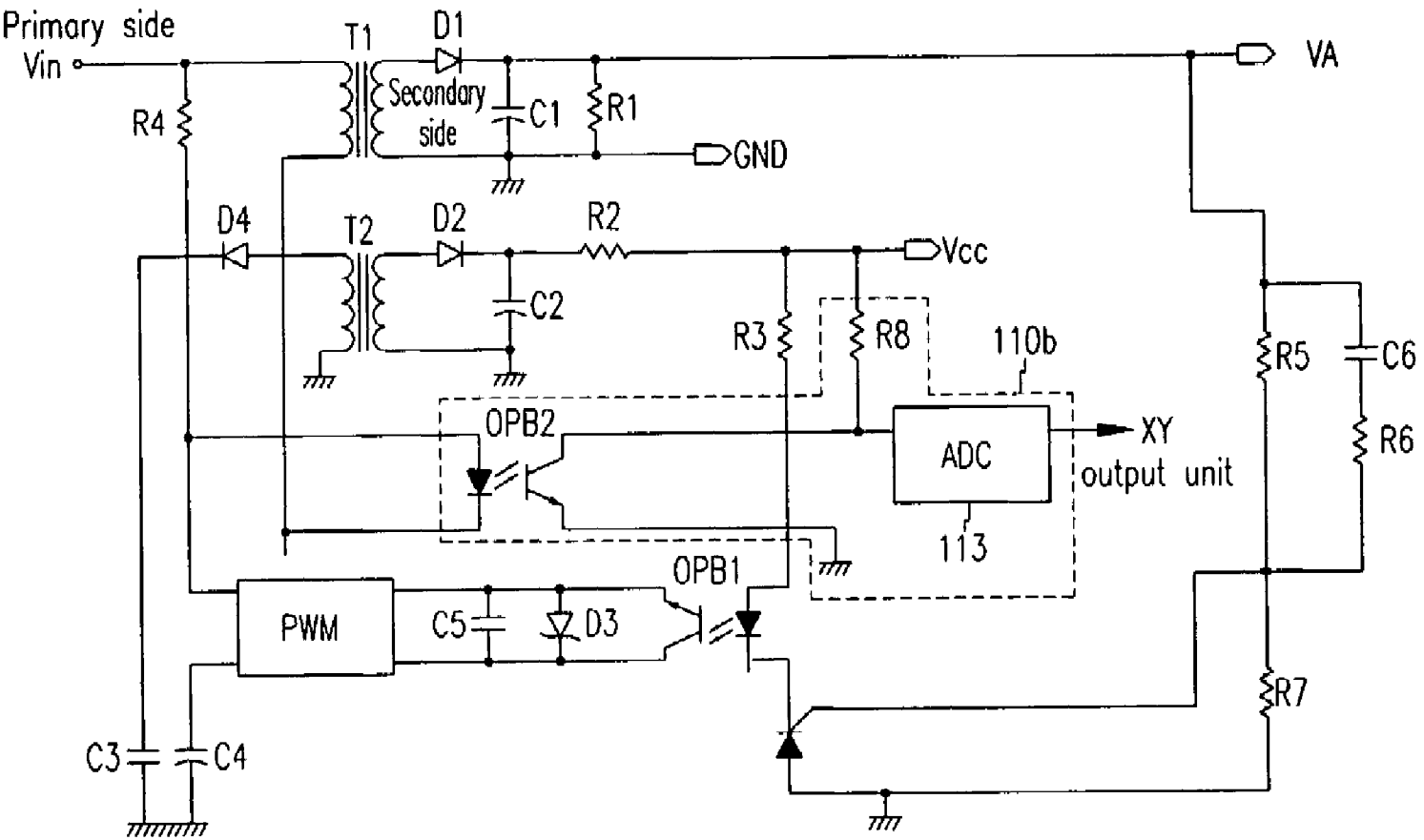
FIG. 3 is a circuit diagram of a power supply including a power off detector according to a second embodiment of the present invention.

FIG. 3 is a circuit diagram of the power supply 100 including the power off detector 110*b* of the PDP according to the second embodiment of the present invention.

As shown in FIG. 3, in the power off detector 110*b* according to the second embodiment of the present invention, a photocoupler OPB2 is connected to the primary side of a transformer T1 to which the AC power is applied through a PFC circuit (not shown), and acts to sense a variation in the input voltage Vin. The sensed analog voltage value is converted by an ADC or microprocessor (referred to hereinafter as an "ADC") 113 into a digital value, which is then transferred to the XY output unit 410 of the logic unit 400. The output of the ADC 113 becomes a low level when the AC power is turned off, and a high level when the AC power is turned on.

Upon receiving a low-level signal transferred from the power off detector 110, the XY output unit 410 determines that the AC power has been turned off, and performs a power off sequence to turn off the power to the PDP.

The XY output unit 410 performs the power off sequence in the following manner.

First, the XY output unit 410 checks if the next synchronous signal Vsync from the video signal processor 300 has been input, and continuously outputs reset, address and sustain discharge pulses until the next synchronous signal Vsync is input and then stops outputting driving pulses when the next synchronous signal Vsync is input.

For a predetermined period of time after the next synchronous signal Vsync is input, the XY output unit 410 turns on only switches that supply the sustain discharge voltage to the X and Y electrodes, and turns off all the other driving switches.

Figure 4:
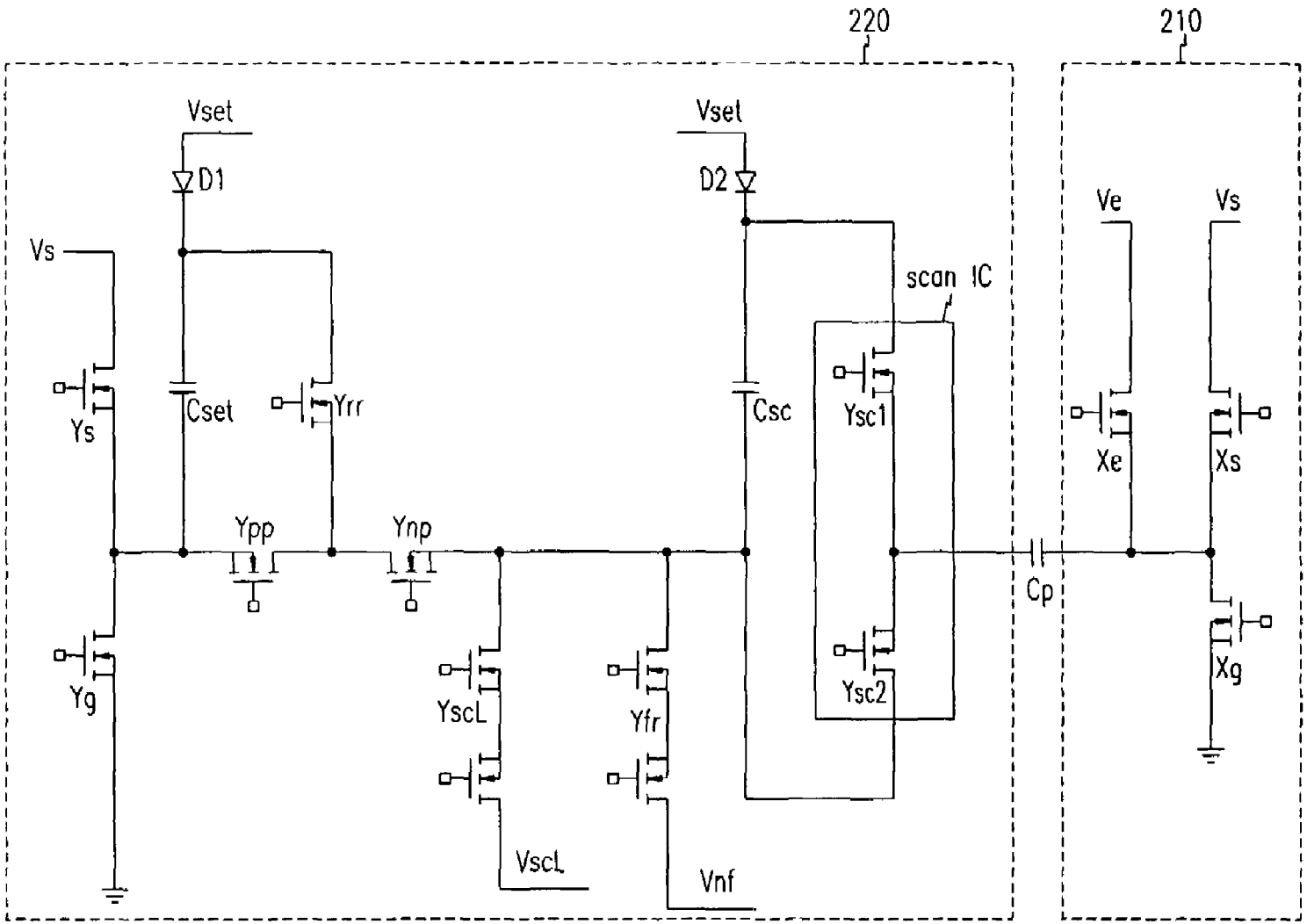
FIG. 4 is a circuit diagram of a Y driver and X driver of a driving circuit of the PDP.

FIG. 4 is a circuit diagram of the Y driver 220 and X driver 210 of the driving circuit 200 of the PDP.

In a power off sequence according to an embodiment of the present invention, only sustain discharge switches Xs and Ys in a circuit shown in FIG. 4 are turned on and all the other switches are turned off.

Thereafter, when the predetermined time period has elapsed, the sustain discharge switches Xs and Ys are turned off and GND switches Yg and Xg are turned on, so that no driving pulses are output.

Figure 5:
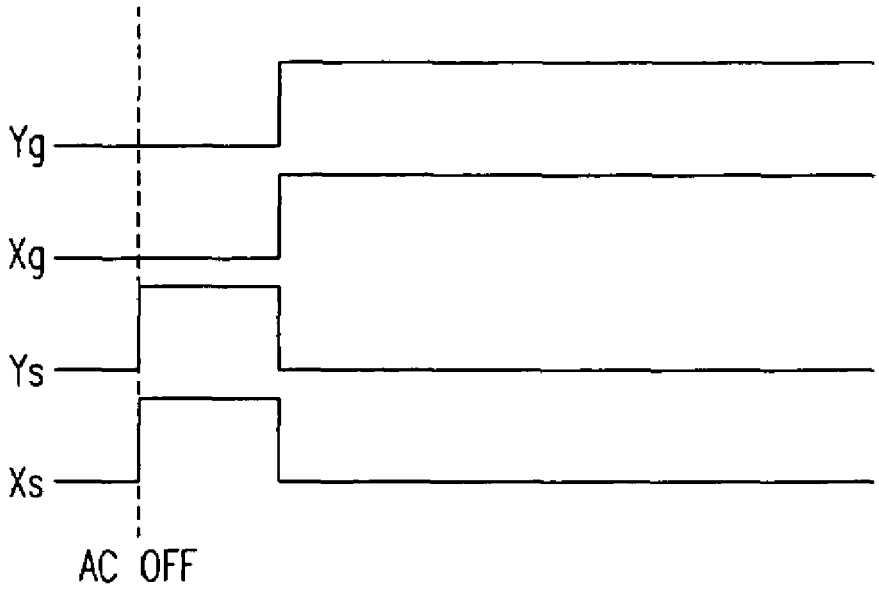
FIG. 5 is a timing diagram of switch control signals according to an embodiment of the present invention.

FIG. 5 is a timing diagram of switch control signals in a power off sequence according to an embodiment of the present invention.

After the on and off operations of the driving switches are controlled in the above manner, all of the data of the logic unit 400 is maintained at a low level, and then, all of the data of the driving circuit 200 is finally maintained at low level and all voltages are turned off so that the PDP is not operating. As a result, the voltages of the X and Y electrodes are maintained at the sustain discharge voltage Vs for the predetermined time period and then gradually reduced to 0V, thereby effectively removing a transient phenomenon which may occur when the power is turned off.

As is apparent from the above description, the present invention provides a PDP power control apparatus and method which can rapidly and accurately sense that AC power to a power supply for a PDP is turned off and perform a predetermined power off sequence, thereby preventing a driving circuit from being damaged and the picture quality of the PDP from being degraded.

While this invention has been described in connection with certain exemplary embodiments, it is to be understood that the present invention is not limited to the disclosed embodiments, but, on the contrary, is intended to cover various modifications and equivalent arrangements included within the spirit and scope of the appended claims.

What is claimed is:

1. A plasma display panel comprising:

a power supply adapted to receive an Alternating Current (AC) power input and to supply power to the plasma display panel;

a driving circuit adapted to drive the plasma display panel with voltages and currents supplied from said power supply;

a logic unit adapted to output a control signal to control said driving circuit; and a plasma panel adapted to display video data from said logic unit, said plasma panel including a plurality of address electrodes and a plurality of first electrodes and a plurality of second electrodes arranged to intersect said address electrodes;

wherein said power supply includes a power off detector adapted to detect an internal voltage of said power supply and to determine if the AC power input to said power supply has been turned off on the basis of the detected internal voltage;

wherein said logic unit is adapted to output a control signal to turn off the plasma display panel in response to an output signal from said power off detector indicating that the AC power input has been turned off; and wherein said power off detector includes a discharge voltage detector adapted to detect a voltage for a sustain discharge of the plasma display panel from among the voltages supplied from said power supply and to output a signal corresponding to the detected voltage.

2. The plasma display panel of claim 1, wherein said power off detector further comprises:

a power off determiner adapted to determine if said AC power input to said power supply has been turned off on the basis of the output signal from said discharge voltage detector and to output a result of the determination to said logic unit.

3. The plasma display panel of claim 1, wherein said logic unit is adapted to output a control signal to said driving circuit to control on/off operations of driving switches that drive said first and second electrodes in response to said output signal from said power off detector.

4. The plasma display panel of claim 3, wherein:

said driving switches comprise a plurality of sustain discharge switches adapted to supply a sustain discharge voltage to said first and second electrodes; and said logic unit is adapted to output a control signal to said driving circuit to turn on said sustain discharge switches for a predetermined period of time upon said output signal of said power off detector being at a low level.

5. The plasma display panel of claim 4, wherein said logic unit is adapted to output a control signal to said driving circuit to turn off said driving switches other than said sustain discharge switches for said predetermined period of time and to output a control signal to said driving circuit to turn off said sustain discharge switches and to turn on switches that supply a voltage of 0V to said first and second electrodes after said predetermined period of time has elapsed.

6. A plasma display panel comprising:

a power supply adapted to receive an Alternating Current (AC) power input and to supply power to the plasma display panel;

a driving circuit adapted to drive the plasma display panel with voltages and currents supplied from said power supply;

a logic unit adapted to output a control signal to control said driving circuit; and a plasma panel adapted to display video data from said logic unit, said plasma panel including a plurality of address electrodes and a plurality of first electrodes and a plurality of second electrodes arranged to intersect said address electrodes;

wherein said power supply includes a power off detector adapted to detect an internal voltage of said power supply and to determine if the AC power input to said power supply has been turned off on the basis of the detected internal voltage;

wherein said logic unit is adapted to output a control signal to turn off the plasma display panel in response to an output signal from said power off detector indicating that the AC power input has been turned off; and wherein said power off detector includes:

a photocoupler adapted to detect a voltage of said AC power input to said power supply; and an Analog to Digital Converter (ADC) adapted to convert an output signal of said photocoupler into a digital signal.

7. The plasma display panel of claim 6, wherein said power off detector is adapted to output a high-level signal to said logic unit when said AC power is turned on, and to output a low-level signal to said logic unit when said AC power is turned off.

8. A method of driving a plasma display panel, the method comprising:

supplying power to the plasma display panel with a power supply;

driving the plasma display panel with voltages and currents supplied from said power supply via a driving circuit;

outputting a control signal to control said driving circuit with a logic unit;

displaying video data from said logic unit on a plasma panel, said plasma panel including a plurality of address electrodes, a plurality of first electrodes and a plurality of second electrodes arranged to intersect said address electrodes;

detecting a voltage of said power supply by detecting a sustain discharge voltage from among the voltages supplied by said power supply; and outputting a control signal to said driving circuit on the basis of the detected voltage to control on/off operations of driving switches so as to perform a normal operation or a power off operation;

wherein outputting a control signal to said driving circuit includes;

comparing a value of the detected voltage with a prestored reference voltage value;

determining if an Alternating Current (AC) power input to said power supply has been turned off on the basis of a result of the comparison; and outputting said control signal on the basis of a result of the determination to turn off the plasma display panel upon the AC power input has been turned off.

9. The method of claim 8, further comprising setting said reference voltage value to a difference between a reduced voltage value of said logic unit and a value of said sustain discharge voltage during normal operation.

10. The method of claim 8, wherein detecting a voltage of said power supply comprises:

detecting a voltage of Alternating Current (AC) power input to said power supply;

converting the detected voltage into a digital signal; and outputting the converted digital signal to said logic unit.

11. The method of claim 10, wherein:

said voltage of said AC power is detected via a photocoupler; and said digital signal is set to a high level when said AC power is turned on, and is set to a low level when said AC power is turned off.

12. The method of claim 8, wherein outputting a control signal to said driving circuit comprises:

outputting a control signal for said normal operation until a next synchronous signal is input;

outputting a control signal for a predetermined period of time to said driving circuit to turn off said driving switches other than sustain discharge switches that apply a sustain discharge voltage to said first and second electrodes, upon said next synchronous signal being input; and outputting a control signal to said driving circuit to turn off said sustain discharge switches and to turn on switches that supply a voltage of 0V to said first and second electrodes after said predetermined period of time has elapsed.

13. The method of claim 12, further comprising:

turning off power supply data output to said logic unit after outputting a control signal to said driving circuit; and turning off power supply data output to said driving circuit after an output of said logic unit is turned off.

* * * * *